United States Patent [19]

Herbert

[11] 4,071,000

[45] Jan. 31, 1978

[54] DOUBLE CRANKSHAFT VALVED TWO CYCLE ENGINE

[76] Inventor: Chester L. Herbert, 17972 Athens Ave., Villa Park, Calif. 92667

[21] Appl. No.: 749,501

[22] Filed: Dec. 10, 1976

Related U.S. Application Data

[63] Continuation of Ser. No. 589,194, June 23, 1975, abandoned.

[51] Int. Cl.[2] ..... F02B 25/10

[52] U.S. Cl. ..... 123/51 BD; 123/51 BA; 123/73 D; 123/73 V

[58] Field of Search ..... 123/51 B, 51 BA, 51 BD, 123/73 R, 73 A, 73 C, 73 CA, 73 D, 73 V

[56] References Cited

U.S. PATENT DOCUMENTS

| | | | |
|---|---|---|---|
| 877,834 | 1/1908 | Daniel | 123/73 BA |
| 1,199,204 | 9/1916 | Pieper | 123/73 V |
| 1,424,798 | 8/1922 | Black | 123/73 V |
| 1,578,476 | 3/1926 | Slaught | 123/51 BA |
| 2,246,701 | 6/1941 | Steiner | 123/51 B |
| 2,782,777 | 2/1957 | Jasper | 123/73 V |
| 2,844,131 | 7/1958 | Beveridge | 123/51 BA |
| 2,917,032 | 12/1959 | Mitchener | 123/73 D |
| 3,119,380 | 1/1964 | Armstrong | 123/73 D |
| 3,672,172 | 6/1972 | Hammond | 123/75 RC |
| 3,805,750 | 4/1974 | Tenney | 123/73 A |

*Primary Examiner*—Charles J. Myhre
*Assistant Examiner*—David D. Reynolds
*Attorney, Agent, or Firm*—Knobbe, Martens, Olson, Hubbard & Bear

[57] ABSTRACT

A two cycle engine is disclosed wherein a pair of pistons reciprocate within a common cylinder to operate a pair of crankshafts mounted at opposite ends of said cylinder. Intake mixtures for the cylinder are crankcase-pumped, and both the intake and output ports of each crankcase are valved. This valving prevents combustion within the crankcase and limits the compression volume in order to assure the highest compression of intake gases possible. A piston ring is included at the lower end of the skirt of each piston in order to further reduce the compressed volume.

9 Claims, 6 Drawing Figures

DOUBLE CRANKSHAFT VALVED TWO CYCLE ENGINE

This is a continuation, of application, Ser. No. 589,194, filed June 23, 1975, now abandoned.

BACKGROUND OF THE DISCLOSURE

The present invention relates to two cycle internal combustion engines and more particularly to crankcase-pumped engines.

Many design modifications have been made in crankcase-pumped two cycle internal combustion engines in order to increase their efficiency and to thus increase the power output from the engines. One of the most severe difficulties with engines of this type is the normal requirement that intake and exhaust gases both flow through ports at the lower end of the cylinder which are opened and closed by action of the piston.

These prior art engines operate with reduced engine efficiency, since it is extremely difficult to totally scavenge exhaust gases from the cylinder without wasting excessive amounts of intake fuel when the intake and exhaust ports are opposite one another at one end of the cylinder wall. Furthermore, free flow of intake and exhaust gases through multiple ports is often not possible with such engines, since, in order to scavenge exhaust gases, it is often necessary that the exhaust and intake ports be diametrically opposed in the cylinder wall.

While it has been common in the prior art to place a valve in the intake port of the crankcase in order to intermittently permit flow of a fuel mixture from a carburetor or other fuel mixing device to the crankcase, the piston itself customarily valves the channel between the crankcase and the cylinder, as well as exhaust ports. The convenience and simplicity of this valving arrangement has apparently discouraged attempts to increase the exhaust gas scavenging efficiency by relocating the intake or exhaust ports in the cylinder. The rare attempts in the prior art to properly valve the channel between the crankcase and the intake port, without using the piston as a valving member, have operated inefficiently because of the slow speed valving arrangements utilized. In addition, these prior art valving systems are unsatisfactory for limiting the compression volume and assuring that explosions will not occur in the crankcase. In regard to the latter problem, it will be recognized that the connection of an intake manifold between the pumping crankcase and an intake port may subject the crankcase to hot combustion gases, which may lead to dangerous explosions within the crankcase.

SUMMARY OF THE INVENTION

The present invention overcomes the difficulties of the prior art by placing the intake and exhaust ports of the two cycle internal combustion engine at opposite ends of the cylinder. Two pistons reciprocate in the ends of the cylinder to operate a pair of crankshafts which are geared together to produce output power. The first of these pistons reciprocates past intake ports to time the intake of fuel mixtures pumped in both of the crankcases, while the other piston reciprocates past the exhaust ports of the cylinder to time the flow of exhaust gases into an exhaust manifold. The pair of pistons with their associated intake and exhaust ports therefore permit totally independent timing of the intake and exhaust valving functions, so that a thorough scavenging of exhaust gases from the cylinder occurs during each cycle without excessive loss of intake fuel.

In order to duct each of the crankcases to the intake ports at one end of the cylinder, it is necessary to utilize an intake manifold which, if connected directly to the crankcases, would increase substantially the compression volume within the crankcases and subject the engine to possible dangerous combustion within the crankcase. These difficulties are overcome by incorporating a high speed valve, such as a rotary valve or reed valve, in the output port of each of the crankcases so that the intake manifold is isolated from the crankcases. This valve, in addition to increasing the compression efficiency of the crankcases, prohibits detonation of the fuel in the crankcases as a result of fuel burning down through the intake manifold. In order to further increase the compression efficiency of each of the crankcases, a piston ring is fitted to the lower end of the skirt of each of the pistons in order to reduce the compression volume to the greatest extent possible.

Through the use of intake and exhaust ports at opposite ends of the cylinder, it is possible to construct each of these ports as a ring of openings around the extremities of the cylinder so that unrestricted flow of intake fuel and exhaust gases may occur.

These and other advantages of the present invention are best understood through a reference to the drawings, in which.

Figure 1:
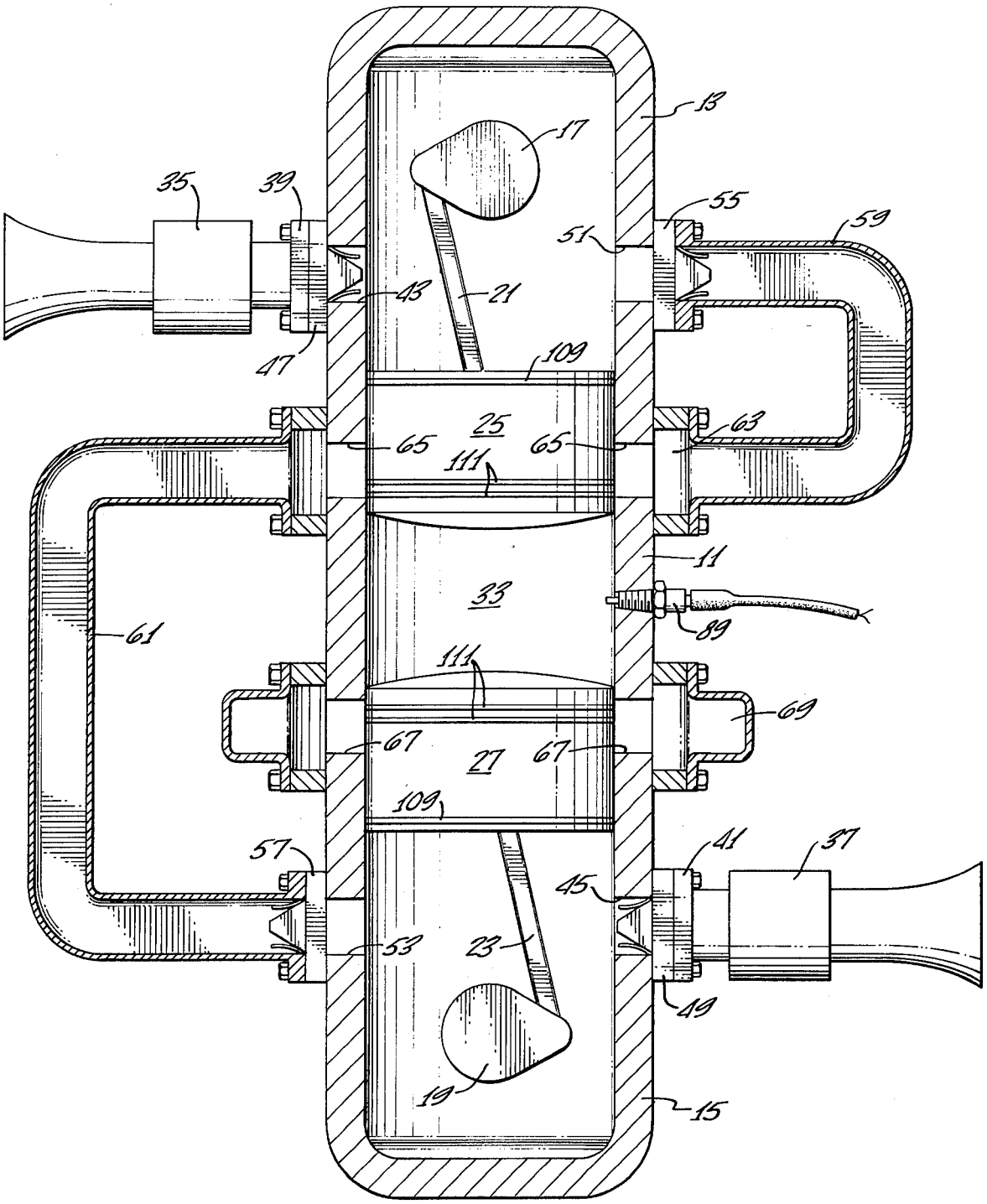
FIG. 1 is a sectional view through the two cycle engine of the present invention, the figure being schematic in nature to show the overall operating characteristics and major apparatus configuration of this engine.
Figure 4:
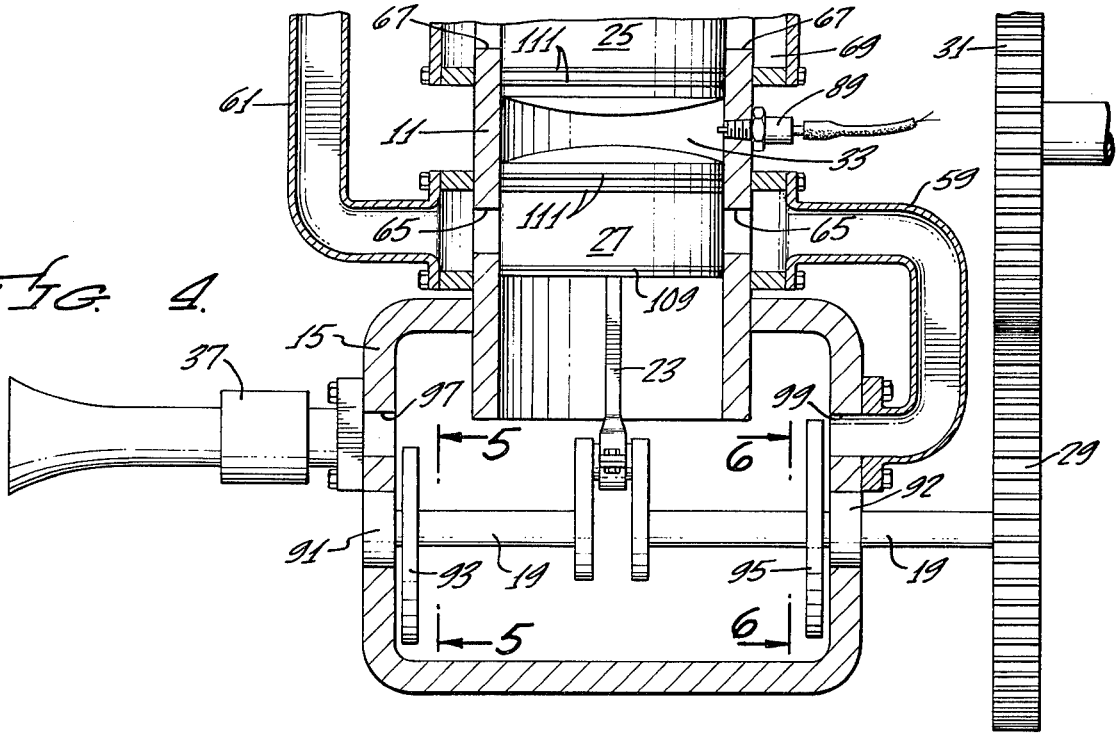
Figure 5:
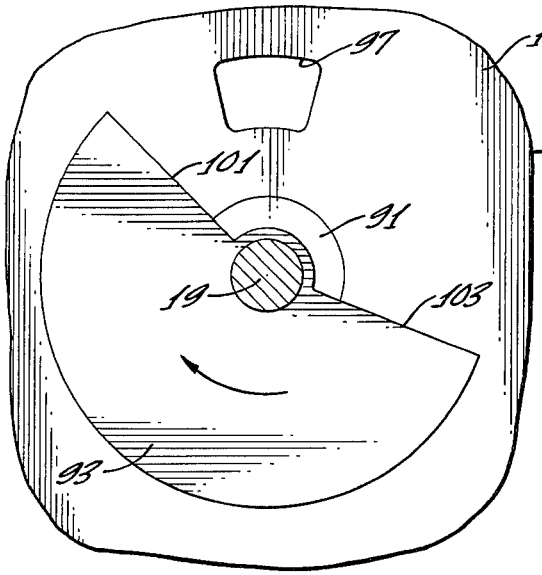
Figure 6:
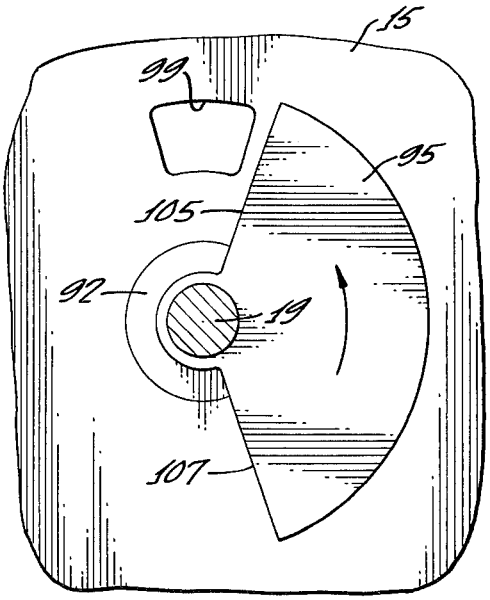

FIG. 4 is a schematic sectional view of one end of the engine of FIG. 1, taken at right angles to the view of FIG. 1 and showing an alternate embodiment of the valving arrangement therefor; and FIGS. 5 and 6 are sectional views of the rotary valves of FIG. 4 taken along lines 5—5 and 6—6, respectively, of FIG. 4.

DETAILED DESCRIPTION OF THE PREFERRED EMBODIMENT

Referring initially to FIG. 1, the engine of the present invention is shown to include an elongate combustion cylinder 11, open at each end to connect with first and second crankcases 13 and 15, respectively. Those skilled in the art will recognize that the crankcases 13 and 15 are normally constructed in a manner which permits a disconnection between these elements and the cylinder 11 through the use of various flanges and gaskets. The view shown in FIG. 1, however, is a stylized or schematic illustration in order to permit the clearest possible description of the basic inventive apparatus and the mode of operation thereof. Thus, throughout the following description it will be recognized by those skilled in the art that normal engineering design practices will be implemented in manufacturing and assembling the various components of the engine.

Each of the crankcases 13 and 15 houses a crankshaft, 17 and 19, respectively, each rotatable about an axis perpendicular to the plane of FIG. 1 in standard crankshaft bearings mounted in opposite sides of the crankcases 13 and 15. Each of the crankshafts 17 and 19, through an eccentric rod journal, pivotally mounts a piston rod 21 and 23, respectively, which piston rods are in turn journalled on wrist pins to a pair of pistons 25 and 27, respectively, in standard fashion.

Each of the crankshafts 17 and 19 rotates in a clockwise direction as viewed in FIG. 1, and each is connected, externally of the crankcases 13 and 15, to a gear. This pair of crankshaft-mounted gears mesh with a third main drive gear which is in turn connected to an output shaft or transmission for producing the main output drive power from the engine. Although FIG. 4 shows an alternate embodiment of the valving arrangement for the engine, the crankshaft-mounted gear 29 connected to the crankshaft 19 is shown in that figure, as is the main output drive gear 31 which meshes with both the crankshaft-mounted gear 29 and a similar gear mounted on the crankshaft 17.

Each of the crankcases 13 and 15 is utilized for pumping intake fuel mixtures into a combustion chamber 33 within the cylinder 11, and a pair of carburetors 35 and 37 are mounted, as by flanges 39 and 41, respectively, to the crankcase walls. The carburetors 35 and 37 communicate with ports 43 and 45, respectively, to the interior of the crankcases 13 and 15. These ports 43 and 45 are located at any convenient position through the walls of the crankcases 13 and 15, but must be positioned beyond the bottom-dead-center position of the pistons 25 and 27 so that they are in communication with the crankcases 13 and 15 throughout the engine cycle. A pair of valves 47 and 49 are mounted between the carburetors 35 and 37 and ports 43 and 45, respectively, in order to control the flow of gases between the carburetors 35, 37 and the crankcases 13, 15. The construction of the valves 47 and 49 will be explained in detail below.

A second pair of ports 51 and 53 are formed in the crankcases 13, 15 respectively and operate as output ports for the crankcase-pumped fuel mixture. These ports 51 and 53 are also conveniently located on the crankcase walls, but must be positioned beyond the bottom-dead-center position of each of the pistons 25 and 27 so as to be in constant communication with the crankcases 13 and 15, respectively. A pair of valves 55 and 57 are mounted adjacent the ports 51 and 53 to control the flow of fuel mixture into a pair of intake manifolds 59 and 61, respectively. These intake manifolds 59 and 61 communicate with an annular intake chamber 63 which in turn communicates with a plurality of radially spaced ports 65 surrounding the cylinder 11. It will be understood that the ports 65 are positioned at a location which permits the piston 27 to completely open these ports to the combustion chamber 33 when the piston 27 is at bottom-dead-center. However, throughout a major portion of the travel of piston 27, the ports 65 will be closed by the piston 25 operating as a valve in a well-known manner.

In a similar manner, a plurality of radial ports 67 communicate with an annular exhaust chamber 69 which is connected to an exhaust manifold (not shown) in a normal manner. The ports 67 are positioned in the cylinder wall 11 so that, at the bottom-dead-center position of the piston 25, these ports are completely open. The ports 67 are closed by the piston 25 during the major portion of the reciprocal cycle of the piston 25.

The pistons 25 and 27, through the interconnecting gearing arrangement 29 and 31, are synchronized so that the pistons 25 and 27 reach their bottom-dead-center positions at approximately the same time. When the pistons are in this position, intake fuel mixture flows through the radial ports 65 scavenging exhaust gases axially through the cylinder 11 and out of the exhaust ports 67. It will be understood by those skilled in the art that, as with other piston-actuated valving arrangements, the valve timing of the intake ports 65 and the exhaust ports 67 may be varied slightly, typically by initially opening the exhaust ports 67, later opening the intake ports 65, closing the exhaust ports 67 and finally closing the intake ports 65, in order to produce the most efficient scavenging of exhaust gases and the highest possible precompression of intake fuel mixtures for the engine. This valve timing arrangement can be accomplished by adjusting the relative rotational positions of the crankshafts 17 and 19 through the interconnection of the gearing arrangement 29 and 31, or by adjusting the positions of the intake and exhaust ports 65, 67 along the axis of the cylinder 11. Through a manipulation of these parameters, the engine design may be varied to produce diverse engine valve timing characteristics.

Both the location and the high speed operating characteristics of the valves 47, 49, 55 and 57 are important to the present invention. It will be recognized by those skilled in this art that reciprocation of the pistons 25 and 27 within the cylinder 11 periodically increases and decreases the volume within the crankcases 13 and 15, respectively. This changing volume characteristic is used in many prior art engine designs in order to permit the engine to pump intake fuel. It has also long been recognized that a high speed valve 47, 49 must be placed between the carburetors 35 and 37 and the crankcases 13 and 15. The term high speed valve in this application defines valves directly mounted on a crankshaft or directly responsive to pressure differentials across the valve for opening and closing. These valves 47, 49 open as the pistons 25, 27 travel from their bottom-dead-center position to their top-dead-center position, admitting a fuel-air mixture from the carburetors 35, 37. When the pistons 25, 27 reach their top-dead-center position, the valves 47, 49 close, interrupting flow between the carburetors 35, 37 and the crankcases 13, 15. The pistons now travel between their top-dead-center positions and bottom-dead-center positions, reducing the volume of the crankcases 13, 15, and increasing the pressure of the fuel-air mixture which has been drawn into the crankcases 13, 15. In the present invention, a second high speed valve 55, 57 is located between each of the crankcases 13, 15 and the intake manifolds 59, 61 to permit pressurized fuel-air mixture to pass from the crankcases 13, 15 when the pressure within the crankcases exceeds the pressure within the intake manifolds 59, 61. These high speed valves 55, 57 are a central feature of the present invention, as is the combination of these valves 55, 57 with an intake manifold structure 59, 61 and an exhaust chamber 69 located at opposite ends of the cylinder 11 for permitting axial scavenging of exhaust gases from the cylinder 11.

Figure 2:
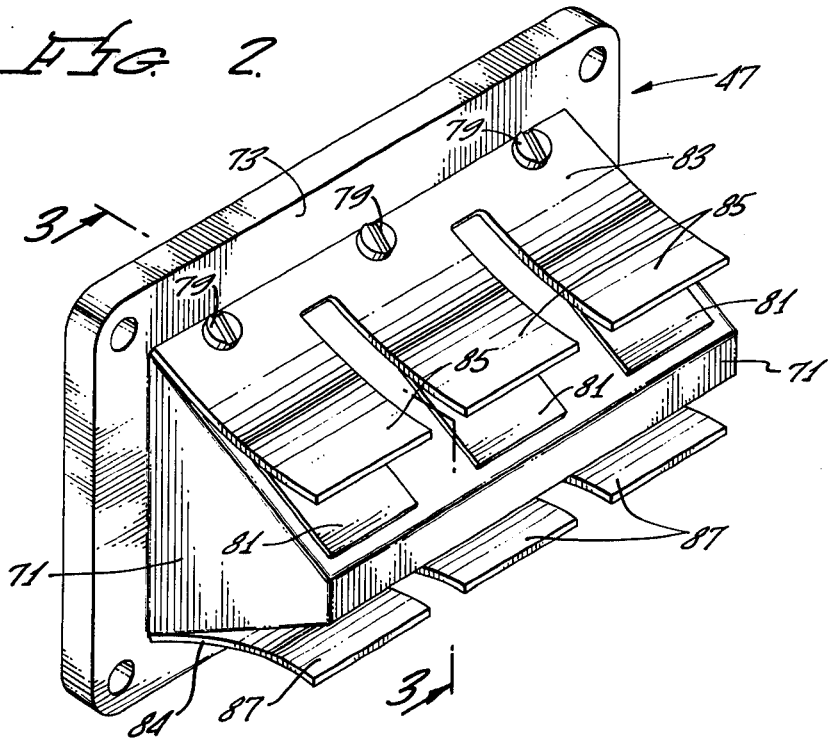
FIG. 2 is a perspective view of the four identical reed valves in the engine of FIG. 1.
Figure 3:
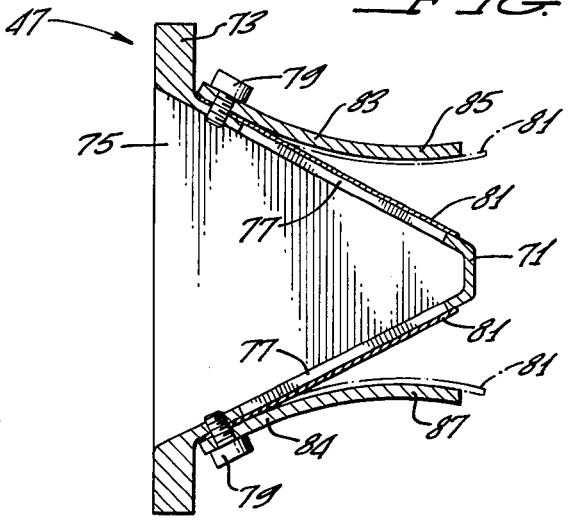
FIG. 3 is a sectional view of the reed valve of FIG. 2 taken along lines 3—3 of FIG. 2.

Referring now to FIGS. 2 and 3, the details of the valves 47, 49, 55 and 57 will be described. In order for the engine of this invention to operate at high RPM and thus produce a maximum possible output horsepower, the valves shown in FIGS. 2 and 3 are designed to operate at extremely high speed, so that the entire engine operates extremely efficiently. For ease of explanation, the construction of valve 47 will be described, it being understood that the remaining valves 49, 55, and 57 are constructed identically. The valve 47 includes a generally V-shaped valve body 71 closed at the ends and terminating in a mounting flange 73 surrounding a valve intake orifice 75. The intake orifice 75 is designed to mate with the mounting flange 39 for the carburetor 35, and the flange 73 is designed to cover the perimeter of the inlet port 43 (FIG. 1) so that the V-shaped valve body 71 fits within the port 43.

The V-shaped valve body 71 includes a plurality of valve outlet ports 77, conveniently located on both sides of the V-shaped valve body 71. Adjacent these ports 77 and rigidly mounted at one extremity to the V-shaped valve body 71 by a plurality of screws 79 are a plurality of resilient metal valve flaps 81. These flaps 81, in their relaxed position, close the ports 77 as shown in FIG. 3. However, when pressure to the left as shown in FIG. 3 of the valve exceeds pressure to the right of this valve, the flaps 81 will open to permit passage of fluid through the valve 47. The screws 79 additionally mount a pair of valve guides 83 and 85 which include a plurality of arcuate guide elements 85 and 87. These elements 85, 87 are rigid and serve to limit the fully opened position of the flaps 81. This limited movement of the flaps 81 protects the flaps 81 from damage and additionally increases the operating speed of the valve 47 by limiting the overall reciprocal movement of the flaps 81. The flaps 81 are shown in dotted lines in FIG. 3 in their fully opened position. It will be recognized that, upon a reversal of the pressure differential across the valve 47 so that (as viewed in FIG. 3) the pressure to the right of the valve exceeds the pressure to the left of the valve, these valve flaps 81 will spring resiliently to their closed position, as shown in solid lines in FIG. 3. This movement of the flaps 81 is accelerated by the pressure differential across the flap 81.

The valves shown in FIGS. 2 and 3 are referred to as reed valves in the present disclosure, this term applying to any valving arrangement wherein a resilient valve member intermittently opens and closes a valve port in response to the pressure differential across the resilient member. It will be recognized that, in order to make the valves operate at the highest possible speed in response to the pressure differentials, the mass of the reeds 81 must be maintained as low as possible consistent with the necessary strength required for closing the apertures 77.

The operation of the valves 47, 49, 55 and 57 in the engine of FIG. 1 will now be described. With both of the pistons 25 and 27 at top-dead-center, that is, at their closest relative position to one another, the ports 65 are closed by the piston 27 and the valves 47, 49, 55 and 57 are all closed so that the crankcases 13 and 15 are isolated from the intake manifolds 59 and 61 and these manifolds are in turn separated from the combustion chamber 33. In addition, the exhaust ports 67 of the combustion chamber 33 are closed by the piston 25. At this point in time, the fuel-air mixture within the combustion chamber 33 has been compressed and a spark plug 89 centrally mounted in the cylinder wall 11 is energized. Burning of the fuel-air mixture within the combustion chamber 33 drives the pistons 25 and 27 away from one another, compressing the fuel-air mixture within the crankcases 13 and 15. When the pressure within the crankcases 13 and 15 exceeds the pressure within the intake manifolds 59 and 61, the valves 55 and 57 will open, admitting fuel-air mixture under pressure into the intake manifolds 59 and 61. So long as the pistons are travelling toward bottom-dead-center, the valves 55 and 57 will remain open. When the piston 25 clears the exhaust ports 67, exhaust gases from the combustion chamber 33 will begin to flow into the exhaust manifold 69. When the piston 27 clears the intake ports 65, the fuel-air mixture under pressure in the intake manifolds 59 and 61 will flow into the combustion chamber 33 under pressure and will assist in scavenging exhaust gases from the combustion chamber 33.

As soon as the pistons 27 and 25 have cleared the ports 65 and 67, further downward movement toward the bottom-dead-center position of these pistons will continue to pump fuel-air mixture out of the crankcases 13 and 15 through the manifolds 59 and 61 and into the combustion chamber 33 to complete the exhaust gas scavenging process. As soon as the pistons 25 and 27 reach the bottom-dead-center position, however, the pressure within the crankcases 13 and 15 will be reduced to a pressure below the pressure within the intake manifolds 59 and 61. When this occurs, the valves 55 and 57 will close in response to the reverse pressure differential. Simultaneously, the valves 47 and 49 will open when the pressure within the crankcases is reduced below atmospheric pressure. The pistons now travel toward their top-dead-center positions, closing the ports 65 and 67 and compressing the fuel-air mixture within the combustion chamber 33 for the next succeeding power stroke. During this entire cycle as gas is being compressed within the combustion chamber 33, the valves 47 and 49 remain open, filling the crankcases 13 and 15 with fuel-air mixture to be pumped into the combustion chamber 33 on the next cycle.

The valves 55 and 57 therefore isolate the intake manifolds 59 and 61 from the crankcases 13 and 15 so that a higher compression ratio may be achieved. Furthermore, these valves serve a safety function in that any detonation which may occur within the intake manifolds 59 and 61 due to the mixing of hot exhaust gases with fuel-air intake mixture cannot ignite fuel within the crankcases 13 and 15. Such ignition, and the resulting explosion could severely damage the engine, and prior art engines attempting to utilize an axial scavenging system have been subject to explosion because of their failure to properly valve the interconnection between the crankcases 13 and 15 and the intake manifolds 59 and 61.

The most important characteristics, therefore, of the engine shown in FIGS. 1 through 3 is the high speed operation of the reed valves 47, 49, 55 and 57 which permits high speed operation of the engine to produce a more efficient power conversion and the placement of the valves 55, 57 at the junction of the intake manifolds 59, 61 and the crankcases 13, 15 to permit higher compression ratios within the engine and to prohibit explosions within the crankcases 13, 15. When these features are combined with an engine which scavenges axially within the cylinder 11 between a plurality of inlet ports at one end of the cylinder 11 and a plurality of exhaust ports 67 at the other end of the cylinder 11, an extremely efficient, crankcase-pumped two cycle engine may be constructed which will produce extremely high horsepower output at high RPM without danger of explosion and with a resulting high efficiency in engine performance.

Referring now to FIGS. 4 through 6, an alternate embodiment of the engine of the present invention will be described. While only the crankcase at one end of the engine embodiment of FIG. 4 is shown, it will be understood that the engine is designed in a manner similar to the engine shown in FIG. 1. That is, it contains a pair of opposed pistons in a single cylinder operating in synchronism with one another and utilizes an axial scavenging of exhaust gases within the combustion chamber. Only the valving arrangement within the crankcases has been changed, and one of these crankcases is shown in FIG. 4. It will be understood that the other crankcase operates identically, as with the case of the engine of FIG. 1.

Referring now in detail to the alternate embodiment of FIG. 4, again a cylinder 11 is connected to a pair of crankcases, one of which is shown as the crankcase 15. In the sectional view of FIG. 4 the crankcase is shown to lie in an axis parallel with the plane of the figure in order to more clearly show the valving arrangements. The crankshaft 19 in this embodiment is mounted in journals or bearings 91 and 92 on opposite sides of the crankcase 15. As explained previously, the crankshaft 19 is connected to a driving gear 29 which in turn meshes with a main output drive gear 31 used to synchronize the two crankshafts of this engine. The crankshaft, as in the previous embodiment, is eccentrically and rotatably mounted to a piston rod 23 in standard fashion, which rod 23 in turn connects to a piston 27. In addition, in this embodiment the crankshaft 19 carries a pair of rotary valve discs 93 and 95. These discs 93, 95 are mounted rigidly on the crankshaft 19 in a position adjacent the walls of the crankcase 15 and are designed to intermittently open and close a crankcase inlet port 97 and a crankcase outlet port 99.

Rotary valves have commonly been utilized on the intake side of the crankcase of two cycle, crankcase-pumped engines in the past. The design of the rotary valves 93 and 95 in the present invention is similar to prior art rotary valves, in that the valves rotate in close proximity with a port located in the crankcase 15 so that they effectively seal the ports 97 and 99 when the discs 93 and 95 are positioned across the face of these ports 97 and 99, but open the ports intermittently. The particular configuration of the rotary valve discs 97 and 99 is shown in FIGS. 5 and 6, respectively. As shown in FIG. 5, the crankcase inlet rotary disc valve 93 has a sector cut therefrom to intermittently open the valve port 97. A leading edge 101 of the remaining portion of the valve disc 93 serves to close the inlet port 97 to the crankcase 15. In a typical configuration, this leading edge 101 closes the port 97 when the piston 27 is at 45° after top-dead-center. The trailing edge 103 of the rotary valve disc 93 opens the inlet valve port 97 when the piston 27 is at 110° before top-dead-center.

Similarly, a segment is cut from the valve disc 95 (FIG. 6) to form a leading edge 105 which closes the outlet valve port 99 when the piston 27 is at 20° after top-dead-center. A trailing edge 107 of the rotary valve disc 95 opens the outlet port 99 when the piston 27 is at 20° before bottom-dead-center.

The rotary valve discs 93 and 95 operate at extremely high speed to open and close the valves 97 and 99 to perform a crankcase pumping action similar to the operation of the reed valves of FIGS. 1 through 3. In the embodiment of FIG. 4, the rotary valve 93 opens the port 97 as the piston 27 is moving between its bottom-dead-center and top-dead-center positions to allow the reduced pressure within the crankcase 15 to draw ambient air through the carburetor 37 and thereby fill the crankcase 15 with a fuel-air mixture. The second rotary valve 95 then opens to permit this fuel-air mixture to be pumped into the intake manifolds 61 as the piston 27 moves from its top-dead-center position to its bottom-dead-center position, pumping fuel-air mixture first into the intake manifold 61 and then into the combustion chamber 33 when the intake ports 65 are cleared by the piston 27. It will be understood, therefore, that the embodiment of FIG. 4 operates identically with the embodiments of FIG. 1, in that a high speed valve, that is a reed or rotary disc valve, operates to open and close both the inlet and outlet ports of the crankcases 13 and 15 to permit isolated compression within the crankcases 13 and 15 and manifolds 59 and 61, thereby increasing the compression ratio of the engine while prohibiting exploding gas within the manifolds 59 and 61 from detonating the fuel-air mixture within the crankcases 13 and 15.

While a rotary disc valve has been shown in the embodiments of FIGS. 4 through 6, it will be understood that various arrangements are known in the prior art for operating rotary valves through a variety of channels and discs connected or constructed as a part of the crankshaft 19. While these valves are well known for connecting a fuel-air mixing device to a crankcase, they have not been used in the prior art for connecting the crankcase to an intake manifold.

In the embodiments of FIGS. 1 and 4, an additional piston ring 109 is located at the bottom of each of the piston skirts. As is well known, piston rings 111 are commonly included adjacent the crown of the pistons 25 and 27 in internal combustion engines, but the present invention includes the placement of this additional ring 109 adjacent the extremity of the skirt in order to increase the compression efficiency within the crankcases 13 and 15. This piston ring 109 therefore prohibits the annular space between the pistons 25, 27 and the cylinder wall 11 beneath the normal piston rings 111 from becoming a part of the compression space within the crankcases 13 and 15, and increases engine efficiency to the extent that this space is removed from the compression space within the crankcases 13 and 15. An important advantage of the additional piston ring 109 adjacent the extremity of the skirt is the assurance of isolation between the crankcases 13 and 15 and the intake and exhaust ports 65, 67. Thus, without this additional piston ring 109, when the piston 25 approaches its top-dead-center position, a certain amount of leakage would occur directly between the crankcase 13 and the port 65. This leakage prevents the valve 55 in the embodiment of FIG. 1, for example, from completely controlling passage of fuel-air mixture between the crankcase 13 and the manifold 59. Similarly, in the embodiment of FIG. 1, the piston ring 109 on the piston 27 prohibits compressed fuel-air mixture within the crankcase 15 from escaping into the manifold 69 past the skirt of the piston 27. A similar advantage is realized from the use of the piston ring 109 in the embodiment of FIG. 4. Thus, the piston ring 109 serves to further isolate the manifold 59 and thus the manifold 61 from the crankcase 13 and additionally isolates the crankcase 15 from the exhaust manifold 69 so that the valves 55, 57, 95, in combination with the pistons 25, 27, serve to completely isolate the manifolds 59 and 61 from the crankcase 13, 15 and combustion chamber 33 during certain periods of the engine cycle.

The overall combination of this invention utilizing opposed pistons operating in a single cylinder for axial scavenging of exhaust gases, and incorporating high speed valves at the intake and outlet of each of the crankcases for increasing the compression ratio of the engine and isolating the intake manifolds 59 and 61 from the crankcases 13 and 15 as a safety measure, provides an extremely efficient, safe, two cycle, crankcase-pumped engine the performance of which has not been realized in the prior art.

What is claimed is:

1. A two cycle internal combustion engine having a power stroke on each rotation of the crankshaft, comprising:

a cylinder open at both ends and including a plurality of intake ports passing through the cylindrical wall of said cylinder at one end and a plurality of exhaust ports passing through the cylindrical wall of said cylinder at the other end;

a pair of crankcases connected at opposite ends of said cylinder, each of said crankcases including inlet and output ports;

a pair of crankshafts mounted in said pair of crankcases;

a pair of pistons each having a skirt and each connected to one of said crankshafts for reciprocation in opposite ends of said cylinder, the skirt of one of said pistons periodically covering and uncovering said cylinder intake ports and thereby opening and closing said intake ports to said cylinder during said reciprocation and the other of said pistons periodically covering and uncovering said cylinder exhaust ports and thereby opening and closing said exhaust ports to said cylinder during said reciprocation;

means for connecting both of said crankshafts to a single output shaft to produce output power;

means for conducting a mixture of fuel and air to said inlet ports of each of said crankcases;

a manifold connected exclusively to said outlet ports of both of said crankcases and to said plural intake ports of said cylinder;

a high speed valve mounted on each of said crankcases to periodically open and close said inlet ports of each of said crankcases; and high speed valve means for preventing detonation of fuel contained in said crankcases, said means mounted on each of said crankcases to periodically open and close said outlet ports of each of said crankcases.

2. A two cycle internal combustion engine as defined in claim 1 wherein said high speed valve mounted on each of said crankcases for opening and closing said inlet ports and said high speed valve means mounted on each of said crankcases opening and closing said outlet ports are rotary valves mounted on said pair of crankshafts and positioned adjacent the wall of said crankcases, said rotary valves on said outlet ports periodically isolating said crankcases from said intake manifold.

3. A two cycle internal combustion engine as defined in claim 1 wherein said high speed valves mounted on each of said crankcases to periodically open and close said inlet ports and said high speed valve means mounted on each of said crankcases to periodically open and close said outlet ports are one-way valves responsive to pressure differentials across said valves to open and close said valves.

4. A two cycle internal combustion engine as defined in claim 1 wherein said plurality of intake ports are spaced around the circumference of said cylinder at one end of said cylinder and wherein said manifold includes an annular manifold section surrounding said one end of said cylinder for conducting fuel-air mixture to each of said plural intake ports.

5. A two cycle internal combustion engine having a power stroke on each rotation of the crankshaft, comprising:

a cylinder open at both ends, said cylinder including an intake port passing through the cylindrical wall of said cylinder at one end of said cylinder and an exhaust port passing through the cylindrical wall of said cylinder at the other end of said cylinder;

a pair of pistons reciprocating in opposite ends of said cylinder, said pistons operating to periodically block and unblock said intake and exhaust ports during said reciprocation;

a pair of compression enclosures mounted and sealed to opposite ends of said cylinder;

an intake conduit connected exclusively between each of said compression enclosures and said intake port; and a pair of high speed valve means for preventing the detonation of fuel contained in said compression enclosures, said means mounted at the junction of each of said compression enclosures and said intake conduit for periodically opening and closing each of said compression enclosures to said intake conduit.

6. A two cycle internal combustion engine as defined in claim 5 wherein said pair of high speed valve means comprise rotary valves operating in synchronism with the motion of said pair of pistons, said rotary valves periodically isolating said compression enclosures from said intake conduit.

7. A two cycle internal combustion engine as defined in claim 5 wherein each of said pair of high speed valve means comprises a one-way valve responsive to pressure differentials across said valve for opening and closing.

8. A two cycle internal combustion engine as defined in claim 5 additionally comprising:

a pair of carburetors connected to each of said compression enclosures; and a pair of high speed valves positioned between said carburetors and said compression enclosures for periodically admitting fuel-air mixture from said carburetors to said compression enclosures.

9. A two cycle internal combustion engine as defined in claim 5 wherein said intake port comprises plural intake ports positioned around the circumference of said cylinder wall at said one end of said cylinder wall and wherein said intake conduit includes an annular manifold surrounding said cylinder for communication with each of said intake ports.

* * * * *